US008066141B2

(12) United States Patent
Casale et al.

(10) Patent No.: US 8,066,141 B2
(45) Date of Patent: Nov. 29, 2011

(54) SEALED PACKAGE FOR POURABLE FOOD PRODUCTS

(75) Inventors: Cristiano Casale, Spilamberto (IT); Sara De Simoni, Modena (IT)

(73) Assignee: Tetra Laval Holdings & Finance SA, Pully (CH)

( * ) Notice: Subject to any disclaimer, the term of this patent is extended or adjusted under 35 U.S.C. 154(b) by 1259 days.

(21) Appl. No.: 10/531,295

(22) PCT Filed: Oct. 13, 2003

(86) PCT No.: PCT/EP03/11308

§ 371 (c)(1), (2), (4) Date: Nov. 15, 2005

(87) PCT Pub. No.: WO2004/035388

PCT Pub. Date: Apr. 29, 2004

(65) Prior Publication Data

US 2006/0138137 A1 Jun. 29, 2006

(30) Foreign Application Priority Data

Oct. 14, 2002 (IT) ..... TO2002A0891

(51) Int. Cl.
*B65D 17/34* (2006.01)

(52) U.S. Cl. ..... 220/270; 220/268; 220/269; 220/257.2; 220/258.1; 220/258.2; 220/258.3; 220/258.5; 215/232.2; 215/255; 215/305; 426/115; 426/116; 426/117; 222/541.9; 229/123.2

(58) Field of Classification Search ..... 220/270, 220/257.2, 259.3, 258.1, 258.2, 269, 268, 220/257.1, 242, 241, 266, 265, 258.3, 258.5; 215/232.2, 255, 305; 426/115, 116, 117; 222/541.9; 229/123.2
See application file for complete search history.

(56) References Cited

U.S. PATENT DOCUMENTS 3,576,272 A * 4/1971 Colby ..... 220/270
4,258,876 A 3/1981 Ljungcrantz
(Continued)

FOREIGN PATENT DOCUMENTS

DE 69819679 4/2004
(Continued)

OTHER PUBLICATIONS

Preliminary opinion of the EPO Opposition Division issued in connection with corresponding European Patent EP 1 556 286 dated Apr. 27, 2009.

(Continued)

*Primary Examiner* — Anthony Stashick
*Assistant Examiner* — Elizabeth Volz
(74) *Attorney, Agent, or Firm* — Buchanan Ingersoll & Rooney PC

(57) ABSTRACT

A sealed package for pourable food products includes a removable portion and a closable opening device. The opening device has a frame defining a pour opening and fixed to the package about the removable portion, and a cap fitted to the frame to close the pour opening and movable to free the pour opening. A pull-off opening device is housed in the frame and has a rigid plane integral with the removable portion and extractable from the frame, by pulling action, together with part of the removable portion. A pull tab of sheet material is interposed between the removable portion and the plate and attached to both.

21 Claims, 3 Drawing Sheets

U.S. PATENT DOCUMENTS

| | | | | | |
|---|---|---|---|---|---|
| 4,328,905 | A | * | 5/1982 | Hardt | 220/258.2 |
| 4,453,646 | A | | 6/1984 | Harrild | |
| 4,948,015 | A | * | 8/1990 | Kawajiri et al. | 222/107 |
| 5,069,372 | A | * | 12/1991 | Kawajiri et al. | 222/541.9 |
| 5,103,973 | A | * | 4/1992 | Sato | 220/270 |
| 5,108,003 | A | * | 4/1992 | Granofsky | 220/257.2 |
| 5,484,101 | A | * | 1/1996 | Hedberg | 229/125.04 |
| 5,735,426 | A | * | 4/1998 | Babcock et al. | 220/258.2 |
| 5,839,627 | A | * | 11/1998 | Hicks et al. | 222/541.9 |
| 5,915,574 | A | * | 6/1999 | Adams et al. | 215/45 |
| 6,079,618 | A | * | 6/2000 | Hedberg et al. | 229/125.15 |
| 6,129,228 | A | * | 10/2000 | Adams et al. | 215/45 |
| 6,179,147 | B1 | * | 1/2001 | Mogard et al. | 220/258.2 |
| 6,231,491 | B1 | * | 5/2001 | Adams et al. | 493/87 |
| 2001/0054616 | A1 | * | 12/2001 | Ramsey et al. | 220/258 |

FOREIGN PATENT DOCUMENTS

| | | | |
|---|---|---|---|
| EP | 0 340 339 | | 11/1989 |
| EP | 0 658 480 | | 6/1995 |
| EP | 0 943 549 | | 9/1999 |
| EP | 0 943 549 | A1 | 9/1999 |
| JP | 09 095330 | | 4/1997 |
| JP | 2000 229630 | | 8/2000 |
| JP | 2000-229631 | A | 8/2000 |
| JP | 2001 114324 | | 4/2001 |
| WO | WO 00/56612 | A1 | 9/2000 |

OTHER PUBLICATIONS

Communication under Article 96(2) issued in corresponding European Patent Application EP 03788950.8 dated Dec. 6, 2006.

* cited by examiner

SEALED PACKAGE FOR POURABLE FOOD PRODUCTS

TECHNICAL FIELD

The present invention relates to a sealed package for pourable food products.

BACKGROUND ART

As is known, many pourable food products, such as fruit juice, UHT (ultra-high-temperature treated) milk, wine, tomato sauce, etc., are sold in packages made of sterilized packaging material.

A typical example of such a package is the parallelepiped-shaped package for liquid or pourable food products known as Tetra Brik Aseptic (registered trademark), which is produced by folding and sealing a web of laminated packaging material. The packaging material has a multilayer structure comprising a base layer, which imparts strength and rigidity to the package, and which may be defined by a layer of fibrous material, e.g. paper, or mineral-filled polypropylene material. The base layer is covered on both sides with layers of thermoplastic material, e.g. polyethylene films; and, in the case of aseptic packages for long-storage products, such as UHT milk, the packaging material comprises a layer of oxygen-barrier material, e.g. aluminium foil, which is superimposed on a layer of thermoplastic material, and is in turn covered with another layer of thermoplastic material eventually forming the inner face of the package contacting the food product.

As is known, such packages are produced on fully automatic packaging machines, on which a continuous tube is formed from the web-fed packaging material. The web of packaging material is sterilized on the packaging machine, e.g. by applying a chemical sterilizing agent, such as a hydrogen peroxide solution, which, after sterilization, is removed, e.g. vaporized by heating, from the surfaces of the packaging material; and the web of packaging material so sterilized is maintained in a closed sterile environment, and is folded and sealed longitudinally to form a vertical tube.

The tube is filled with the sterilized or sterile-processed food product, and is sealed and cut along equally spaced cross sections to form pillow packs, which are then folded mechanically to form the finished, e.g. substantially parallelepiped-shaped packages.

Alternatively, the packaging material may be cut into blanks, which are folded on forming spindles to form the packages, which are then filled with the food product and sealed. An example of this type of package is the "gable-top" package commonly known by the trade name Tetra Rex (registered trademark).

Such packages are normally fitted with closable opening devices to protect the food product in the package from contact by external agents, and to enable withdrawal of the product.

The most commonly marketed opening devices at present comprise a frame defining a pour opening and applied about a removable or pierceable portion of the top wall of the package; and a cap hinged or screwed to the frame and which can be removed to open the package. Alternatively, other types of opening devices, e.g. sliding types, are also used.

The removable portion of the package may be defined, for example, by a so-called "prelaminated" hole, i.e. a hole formed in the base layer of the packaging material before the base layer is covered with the thermoplastic layers and with the barrier layer, which closes the hole to ensure aseptic airtight sealing, while at the same time being easily pierced.

In a known solution described in patent application EP-A-331798, the cap of the opening device is screwed to the frame, and has an inner portion extending through the pour opening and fixed directly to the laminating material covering the hole in the base layer of the packaging material, so that, as the cap is unscrewed off the frame, the removable portion remains attached to the cap and is twisted off the rest of the top wall of the package.

Though relatively practical, the above solution has the drawback that, when twisting off the removable portion, the edge of the laminating material, as opposed to being torn neatly, tends to fray, thus preventing the food product from being poured smoothly.

To eliminate the above drawback, pull-off package opening systems have been designed. One example is described and illustrated in Patent Application EP-A-943549, which relates to a closable opening device substantially comprising an externally threaded, annular frame fixed about the removable portion of the package and defining a circular pour opening for the food product; a removable cap screwed to the frame to close the pour opening; and pull-off opening means housed in the pour opening and defined by a rigid plastic plate, which is glued to the removable portion, is connected integrally to the frame by breakable bridges, and can be pulled off the frame together with part of the removable portion.

In this case, the removable portion is defined by a sealing sheet glued to the outside of the package to close a through hole in the package.

The package is opened by unscrewing the cap from the frame, and then pulling the opening plate out of the frame. Being glued to the sealing sheet, the opening plate, when pulled off, also detaches the part of the sealing sheet attached to it, thus exposing the hole in the package.

Though providing for neater opening of the package as compared with "twist-off" solutions, the above solution still leaves room for further improvement.

In particular, the pull exerted by the opening plate on the sealing sheet stretched tautly over the hole in the package calls for a certain amount of effort, and may result in a ragged initial tear.

Moreover, owing to the opening plate being connected to the frame by a number of breakable bridges, opening of the package is jerky, thus possibly resulting in squirting and spillage of the product.

Finally, in the event the package, with the removable portion detached and the cap put back on, is laid horizontally, e.g. is stored for further use in a refrigerator, continual absorption of the food product, particularly if of an aggressive nature, by the edge of the hole in the packaging material may result, after a relatively long period (eight hours on average), in detachment of the opening device from the package and leakage of the contents.

DISCLOSURE OF INVENTION

It is an object of the present invention to provide a sealed package for pourable food products, designed to eliminate the drawbacks typically associated with the aforementioned known packages.

According to the present invention, there is provided a sealed package for pourable food products, having at least one removable portion, and a closable opening device in turn comprising a frame defining a pour opening and fixed to said package about said removable portion, a cap fitted to said frame to close said pour opening and movable to free the pour opening, and pull-off opening means housed in said frame and comprising a rigid plate integral with said removable portion and extractable from the frame, by pulling action, together with at least part of said removable portion; characterized by also comprising a pull-tab of sheet material interposed between said removable portion and said plate and attached to both.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
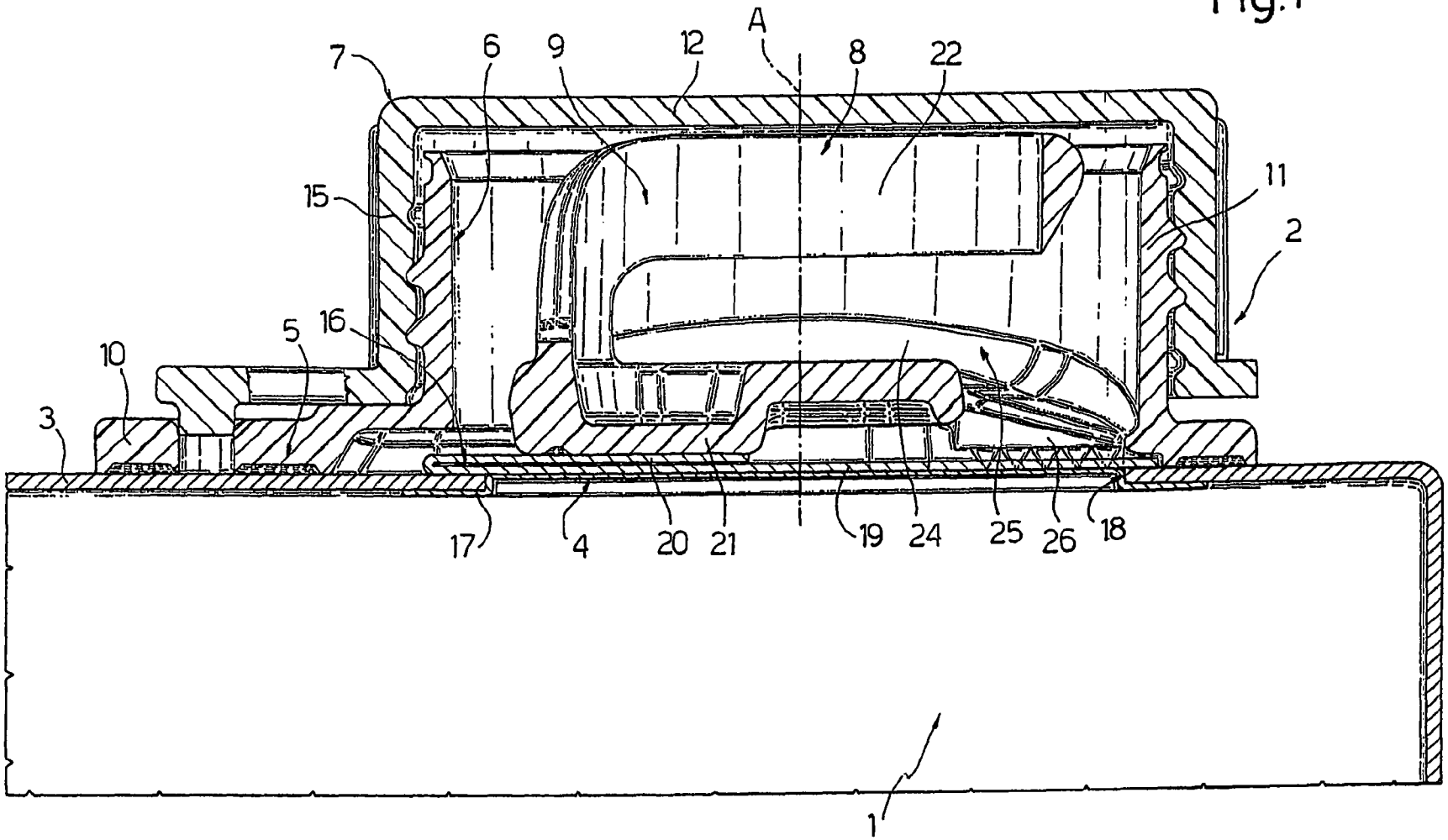
FIG. 1 shows a cross section of a top portion of a sealed package for pourable food products in accordance with the present invention and fitted with a closable opening device.
Figure 2:
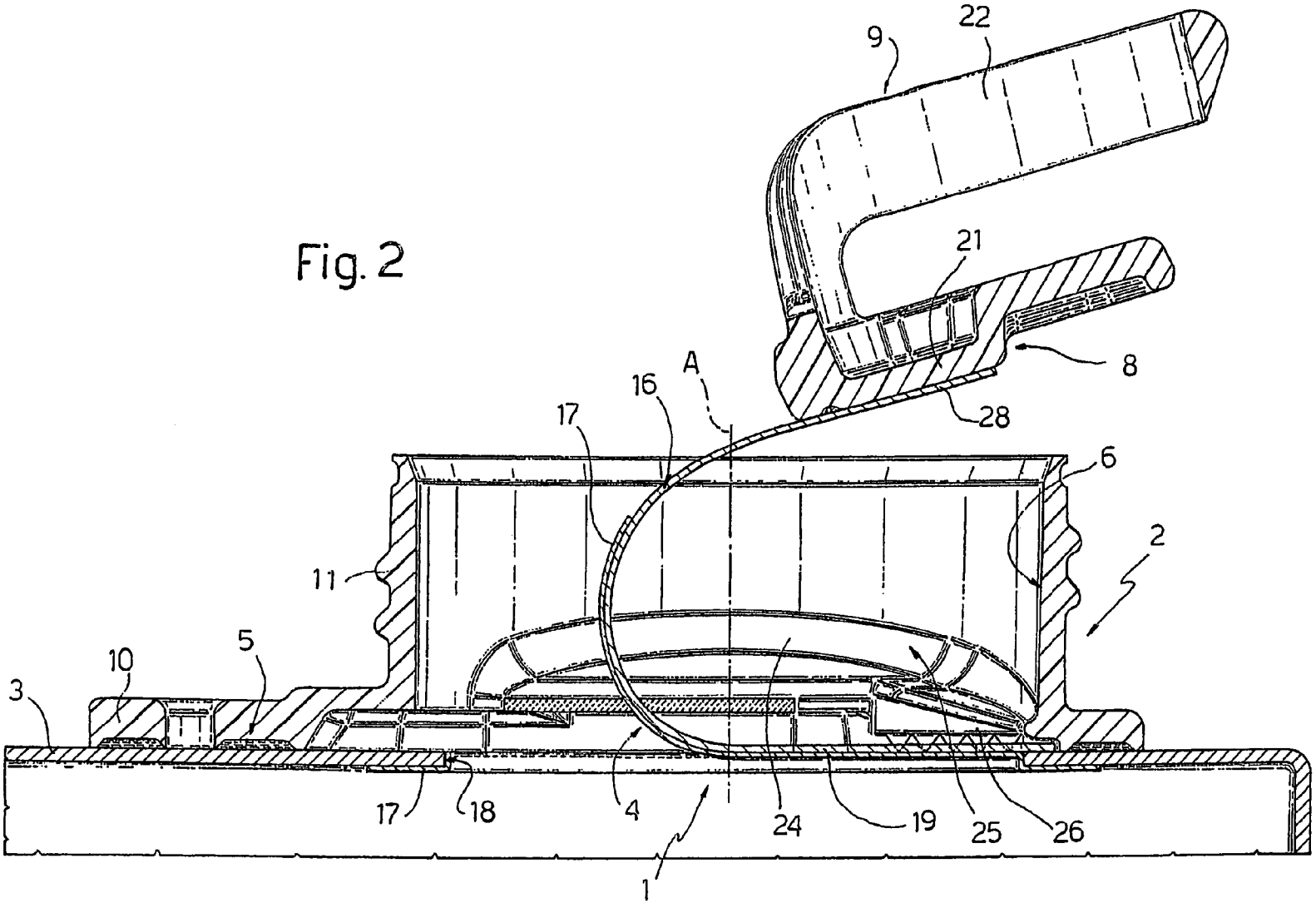
FIG. 2 is similar to FIG. 1, and shows the opening device being removed from the package.

Number 1 in the accompanying drawings indicates as a whole a sealed package (shown only partly) for pourable food products, e.g. a parallelepiped-shaped package known as Tetra Brik Aseptic (registered trademark), which is made of sheet packaging material as described in detail above, and is fitted with a closable opening device 2 made of plastic material and applied to a top wall 3 of package 1.

The packaging material from which package 1 is made has a multilayer structure (not shown) comprising a base layer of fibrous material, e.g. paper, or of mineral-filled polypropylene, covered on both sides with layers of thermoplastic material, e.g. polyethylene film. When package 1 is used for aseptic packaging of long-storage products, such as UHT milk, the packaging material comprises a layer of oxygen-barrier material, e.g. aluminium foil, which is superimposed on a layer of thermoplastic material, and is in turn covered with another layer of thermoplastic material defining the inner face of package 1 eventually contacting the food product.

Opening device 2 is applied to top wall 3 of package 1, at a removable portion 4 of wall 3, i.e. a portion detachable from the rest of package 1 so the food product can be poured out.

Opening device 2 substantially comprises an annular, externally threaded frame 5 fixed to wall 3 of package 1 about removable portion 4, and defining a circular pour opening 6 having an axis A perpendicular to wall 3; a removable cap 7 screwed to frame 5 to close opening 6; and pull-off opening means 8 housed in opening 6 and defined by a rigid plate 9 made of plastic material, integral with removable portion 4, and extractable from frame 5, by pulling action, together with at least part of removable portion 4.

More specifically, frame 5 comprises, integrally, an annular base flange 10—in the example shown, rectangular with rounded corners—heat sealed to wall 3 of packaqe 1, about removable portion 4; and an externally threaded, cylindrical, tubular member 11 of axis A, which defines opening 6 and projects perpendicularly from an inner edge of base flange 10 and from the opposite side of the flange to that fixed to wall 3.

Cap 7 (FIG. 1) comprises, integrally, a disk-shaped portion 12 for closing opening 6; and an internally threaded, cylindrical, annular portion 15 projecting from a circular outer peripheral edge of disk-shaped portion 12, and which screws onto tubular member 11 of frame 5. Once unsealed, cap 7 is movable between said closed position and an open position in which it is detached from frame 5.

According to an important characteristic of the present invention, package 1 also comprises a pull-tab 16 of sheet material interposed between removable portion 4 and plate 9 and attached to both.

In the example shown, removable portion 4 is defined by a patch 17 made of thermoplastic material, normally polyethylene, and applied over a through hole 18 in wall 3, on the side of the packaging material eventually forming the inside of package 1.

Tab 16—substantially defined by a layer of barrier material, typically aluminium, and by a layer of thermoplastic material, normally polyethylene—is fixed, e.g. heat sealed, to patch 17 on the outside of package 1 so as to entirely cover hole 18. The layer of barrier material of tab 16 therefore ensures package 1 is also maintained aseptic at removable portion 4.

More specifically, tab 16 comprises a main portion 19 attached to patch 17 and covering both hole 18 and the edge of the hole; and an end portion 20 folded back onto main portion 19 and attached to plate 9.

Being attached to patch 17, when tab 16 is pulled off by pulling on plate 9, the part of patch 17 sealed to tab 16 is also removed with it to free hole 18. More specifically, tab 16 is removed in an opening direction B lying in the plane of wall 3 and crosswise to the folded edge of end portion 20 of tab 16.

As shown in the accompanying drawings, plate 9 comprises a base portion 21 attached, e.g. glued, to end portion 20 of tab 16; and a substantially ring-shaped grip portion 22 projecting from base portion 21 and accessible through frame 5 when cap 7 is removed.

More specifically, base portion 21 of plate 9 is substantially rectangular with a concave edge facing the fold of tab 16, and is connected integrally to tubular member 11 of frame 5 by thin breakable strips of material 23 parallel to each other and to the opening direction B of tab 16.

Figure 3:
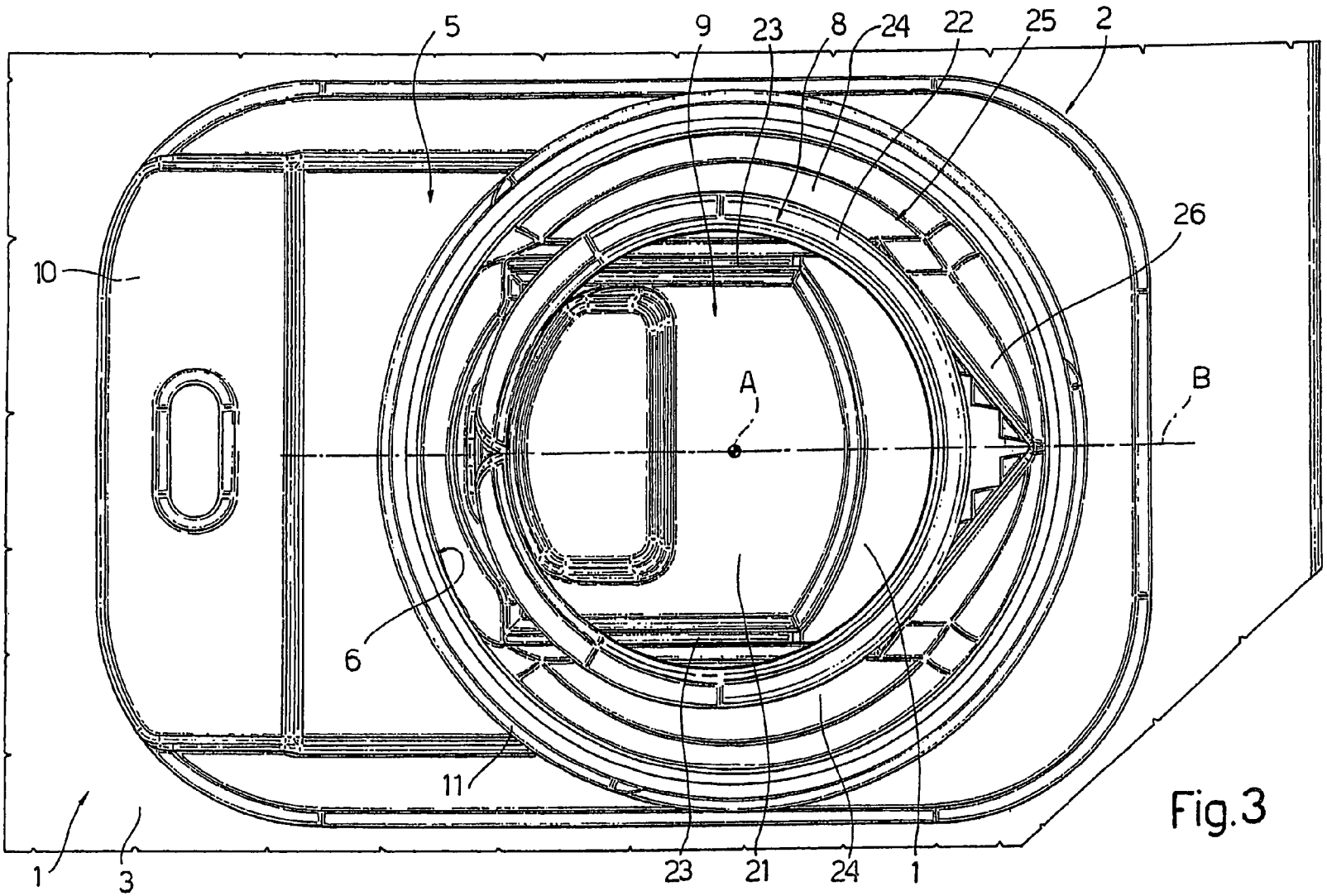
FIG. 3 shows a top plan view of the top portion of the FIG. 1 package, with the cap removed from the opening device.

With particular reference to FIG. 3, breakable strips of material 23 connect opposite sides of base portion 21 of plate 9, originating from opposite vertices of the concave edge, to mutually facing portions 24 of an inner flange 25—substantially V-shaped when viewed from above—of tubular member 11 of frame 5. More specifically, portions 24 or inner flange 25 project inwards of opening 6 from diametrically opposite sides of tubular member 11, and are connected to each other by a V-shaped connecting portion 26 located at the end of tab 16 opposite folded end portion 20. Portion 26 of inner flange 25 has a triangular-toothed edge which, when the package is unsealed, cooperates with and fully removes any residual parts of tab 16 and patch 17 still attached to package 1.

In other words, breakable strips of material 23 define a plate 9—frame 5 parting direction parallel to opening direction B of tab 16.

Grip portion 22 of plate 9 projects from the end of base portion 21 facing the fold of tab 16, and is bent over base portion 21.

Package 1 is unsealed by rotating cap 7 with respect to frame 5, so as to unscrew the cap from the frame, and then pulling plate 9 out of frame 5. Grip portion 22 is ring-shaped so the index finger of the user can be inserted completely to exert pull.

When pulled out of opening 6 of frame 5, plate 9 is detached from tubular member 11 along breakable strips of material 23. At the same time, since base portion 21 of plate 9 adheres to tab 16, the pull exerted on grip portion 22 is transmitted to the folded end portion 20 of tab 16, which detaches from package 1 in direction B, thus removing the part of patch 17 sealed to it, and so freeing hole 18.

More specifically, pull is transmitted from grip portion 22 of plate 9 to the folded end portion 20 of tab 16, and from there to the immediately adjacent area marking the start of the area of tab 16 sealed to patch 17. In other words, pull is directed via tab 16 to one end of the sealed area of hole 18 to assist detachment of the material covering hole 18 and so also obtain a clean tear at the initial tear region.

Moreover, breakable strips of material 23 guide removal of plate 9 in opening direction B of tab 16, thus enabling smooth, linear detachment of the material from package 1.

Once the package is unsealed, the toothed edge of portion 26 of inner flange 25 of frame 5 cuts off tab 16 and the part of patch 17 sealed to it.

In addition to the advantages described above relative to unsealing the package more neatly as compared with known solutions, the sealing system described—employing a patch 17 of thermoplastic material covering the edge of hole 18 from the inside of package 1—ensures perfect sealing of the edge even after package 1 is unsealed. That is, removal of tab 16 detaches the part of patch 17 sealed to tab 16, but not the peripheral portion sealed to the packaging material along the edge of hole 18.

This therefore eliminates any risk of absorption by the packaging material around hole 18 and detachment of opening device 2 if package 1 is left in a horizontal position with cap 7 on and removable portion 4 removed.

Clearly, changes may be made to package 1 as described and illustrated herein without, however, departing from the scope of the accompanying Claims.

In particular, in a variation not shown, the removable portion of package 1 may be formed by forming a hole through the base layer of the packaging material, and laminating the base layer with other layers of the packaging material (at least the layers of thermoplastic material) to cover the hole.

Moreover, opening device 2 may be applied to package 1 using other fastening systems, e.g. heat sealing, and may be of a different type, e.g. comprising a cap hinged to or sliding with respect to the frame.

The invention claimed is:

1. A sealed package of pourable food product comprising: a plurality of walls; a through hole passing through one of the walls; a removable portion fixed directly to the one wall and completely covering the through hole; an upstanding frame fixed to the package at a position surrounding the removable portion, the upstanding frame defining a pour opening through which the pourable food product can flow when a part of the removable portion covering the through hole is removed; a cap fitted to the frame and closing the pour opening, the cap being removable from the frame; a rigid plate positioned in the upstanding frame and extractable from the frame by pulling action; a pull-tab of sheet material having a sealed end at an edge of the through hole, and a free, unsealed end at an opposite end of the pull-tab and at an initial position, the pull-tab of sheet material being attached to the removable portion and the free, unsealed end being attached to the rigid plate, and the pull-tab of sheet material connecting the rigid plate to the removable portion so that pulling action applied to the rigid plate after removing the cap is first applied to the free, unsealed end of the pull-tab of sheet material to remove the free, unsealed end from the initial position, and is subsequently applied to the removable portion attached to the pull-tab of sheet material to cause removal of the part of the removable portion after the free, unsealed end is removed.

2. A package as claimed in claim 1, wherein the pull-tab comprises a main portion and an end portion folded back onto the main portion so that the end portion overlies the main portion, the main portion being attached to the removable portion and the end portion being the free, unsealed end attached to the rigid plate.

3. A package as claimed in claim 1, wherein said plate is connected integrally to the frame by breakable strips of connecting material, the breakable strips being parallel to each other.

4. A package as claimed in claim 1, wherein the removable portion is sealed to an edge of the through hole.

5. A package as claimed in claim 1, wherein the pull-tab completely covers the through hole before the removable portion is removed by pulling action applied to the rigid plate.

6. A package as claimed in claim 1, wherein the one wall includes an exterior surface and an interior surface, and the removable portion is fixed to the inner surface of the one wall.

7. A package as claimed in claim 6, wherein the removable portion is sealed to an edge of the through hole.

8. A package as claimed in claim 1, wherein the one wall includes an exterior surface and an interior surface, the frame being tubular and possessing an outer surface facing an inner surface of the cap, the tubular frame being fixed to the exterior surface of the one wall.

9. A package as claimed in claim 8, wherein the tubular frame does not pass through the through hole in the one wall.

10. A package as claimed in claim 9, wherein the removable portion is fixed to the inner surface of the one wall.

11. A sealed package of pourable food product comprising: a plurality of walls; a through hole passing through one of the walls; a removable portion fixed to the one wall and completely covering the through hole; an upstanding frame fixed to the package at a position surrounding the removable portion, the upstanding frame defining a pour opening through which the pourable food product can flow when a part of the removable portion covering the through hole is removed; a cap fitted to the frame and closing the pour opening, the cap being removable from the frame; a rigid plate positioned in the upstanding frame and extractable from the frame by pulling action; a pull-tab of sheet material having a sealed end at an edge of the through hole, and a free, unsealed end at an opposite end of the pull-tab and at an initial position, the pull-tab of sheet material being attached to the removable portion and the free, unsealed end being attached to the rigid plate; the pull-tab of sheet material not being a part of the rigid plate and not being a part of the removable portion; and the pull-tab of sheet material connecting the rigid plate to the removable portion so that pulling action applied to the rigid plate after removing the cap is first applied to the free, unsealed end of the pull-tab of sheet material to remove the free, unsealed end from the initial position, and is subsequently applied to the removable portion attached to the pull-tab of sheet material to cause removal of the part of the removable portion after the free, unsealed end is removed.

12. A package as claimed in claim 11, wherein the pull-tab comprises a main portion and an end portion folded back onto the main portion so that the end portion overlies the main portion, the main portion being attached to the removable portion and the end portion being the free, unsealed end attached to the rigid plate.

13. A package as claimed in claim 11, wherein the removable portion is sealed to an edge of the through hole.

14. A package as claimed in claim 11, wherein the pull-tab completely covers the through hole before the removable portion is removed by pulling action applied to the rigid plate.

15. A package as claimed in claim 11, wherein said plate is connected integrally to the frame by breakable strips of connecting material, the breakable strips being parallel to each other.

16. A package as claimed in claim 15, wherein the removable portion is fixed to the inner surface of the one wall.

17. A package as claimed in claim 11, wherein the one wall includes an exterior surface and an interior surface, the frame being tubular and possessing an outer surface facing an inner surface of the cap, the tubular frame being fixed to the exterior surface of the one wall.

18. A package as claimed in claim 17, wherein the tubular frame does not pass through the through hole in the one wall.

19. A package as claimed in claim 11, wherein the one wall includes an exterior surface and an interior surface, and the removable portion is fixed to the inner surface of the one wall.

20. A package as claimed in claim 19, wherein the removable portion is sealed to an edge of the through hole.

21. A sealed package of pourable food product comprising: a plurality of walls; a through hole passing through one of the walls; a removable portion fixed directly to the one wall and completely covering the through hole; an upstanding frame fixed to the package at a position surrounding the removable portion, the upstanding frame defining a pour opening through which the pourable food product can flow when a part of the removable portion covering the through hole is removed; a cap fitted to the frame and closing the pour opening, the cap being removable from the frame; a rigid plate positioned in the upstanding frame and extractable from the frame by pulling action; a pull-tab of sheet material having a sealed end at an edge of the through hole, and a free, unsealed end at an opposite end of the pull-tab and at an initial position, the pull-tab of sheet material being attached to the removable portion and the free, unsealed end being attached to the rigid plate, and the pull-tab of sheet material connecting the rigid plate to the removable portion so that pulling action applied to the rigid plate after removing the cap is first applied to the free, unsealed end of the pull-tab of sheet material to remove the free, unsealed end from the initial position, and is subsequently applied to the removable portion attached to the pull-tab of sheet material to cause removal of the part of the removable portion in an opening direction after the free, unsealed end is removed, the rigid plate being connected integrally to the frame by breakable strips of connecting material, the breakable strips being parallel to each other and to the opening direction of the pull-tab.

* * * * *